United States Patent [19]

Smoll

[11] Patent Number: 4,668,955

[45] Date of Patent: May 26, 1987

[54] PLURAL REFLECTOR ANTENNA WITH RELATIVELY MOVEABLE REFLECTORS

[75] Inventor: Allen E. Smoll, Palo Alto, Calif.

[73] Assignee: Ford Aerospace & Communications Corporation, Detroit, Mich.

[21] Appl. No.: 551,379

[22] Filed: Nov. 14, 1983

[51] Int. Cl.[4] ..... H01Q 3/20

[52] U.S. Cl. ..... 343/761; 343/765; 343/781 CA

[58] Field of Search ..... 343/758, 761, 781 P, 343/840, 781 CA, 837, 839, 765, 766

[56] References Cited

U.S. PATENT DOCUMENTS

| | | | |
|---|---|---|---|
| 3,680,141 | 7/1972 | Karikomi | 343/758 |
| 3,795,003 | 2/1974 | Meek et al. | 343/754 |
| 3,845,483 | 10/1974 | Soma et al. | 343/761 |
| 4,044,361 | 8/1977 | Yokoi et al. | 343/754 |
| 4,062,018 | 1/1977 | Yokoi et al. | 343/754 |
| 4,186,402 | 1/1980 | Mizusawa et al. | 343/837 |

FOREIGN PATENT DOCUMENTS

| | | | |
|---|---|---|---|
| 2321613 | 11/1974 | Fed. Rep. of Germany | 343/781 CA |
| 2520498 | 11/1976 | Fed. Rep. of Germany | 343/781 CA |

*Primary Examiner*—Eli Lieberman
*Assistant Examiner*—Michael C. Wimer
*Attorney, Agent, or Firm*—Kenneth R. Allen; Edward J. Radlo; Keith L. Zerschling

[57] ABSTRACT

A method and apparatus are provided for transmitting a microwave signal as a beam having a wavelength small as compared to the size of the reflecting surfaces, wherein a main reflector is stationary with respect to a sub-reflector and the main reflector is motional with respect to the feed. The invention comprises rotating the sub-reflector about a first rotational axis transverse and preferably orthogonal to the guide axis, the first rotational axis being on the vertex of a secondary reflector, thereby directing radiation from a fixed feed to the motional sub-reflector. The primary reflector and sub-reflector are disposed relative to one another to share a common focus or confocal point.

12 Claims, 10 Drawing Figures

PLURAL REFLECTOR ANTENNA WITH RELATIVELY MOVEABLE REFLECTORS

BACKGROUND OF THE INVENTION

1. Field of the Invention

This invention relates to microwave signal couplings and in particular to beam-type microwave couplings between a stationary feed and a movable director. The invention herein applies primarily to microwave applications using dish reflectors wherein the wavelength of the microwave energy is small compared to the size of the dish reflector.

In recent years attention has been given to development of microwave reflector systems wherein the wavelength is small compared to the size of the reflector. In such instances, microwave signal propagation can be treated much like traditional optical signal propagation with mirrored reflectors, lenses and the like in so-called beam waveguide systems.

Microwave antennas requiring only a limited range of motion, for example less than a few tens of degrees, are frequently employed in satellite communications for earth stations or mounted on spacecraft. Signal losses are particularly critical in spacecraft applications, since communications must normally take place with a limited amount of power over great distances.

It is generally preferably to locate microwave electronic equipment on the stationary side of the motional interface of a steerable microwave antenna and to transmit the microwave signals across the motional interface. For example, the feed may be mounted on the base and the signals may be transmitted to a focal point through an open or beam-type waveguide. The rotary interface is accomplished by beaming or propagating the signals between two reflectors which are each mounted on opposing sides of the motional interface.

2. Description of the Prior Art

In prior art beam waveguide feed systems, it has generally been taught that the axis of rotation be parallel and generally along the guide axis or axis of signal propagation. Therefore, to obtain rotation having a maximal degree of freedom, a pair of reflectors is required for each rotary axis.

A representative example of a prior art beam feed in U.S. Pat. No. 4,186,402 to Mizusawa et al. The Mizusawa et al. patent discloses a steerable microwave antenna in which microwave energy is conveyed between a movable aerial portion and a fixed portion containing the primary feed. The beam waveguide consists of four reflectors which together with the moveable aerial portion are rotatable relative to the fixed portion about one axis along the guide axis and rotatable about a second orthogonal axis along the guide axis.

U.S. Pat. No. 4,044,361 to Yokoi et al. discloses a satellite tracking antenna including a main reflector, a sub-reflector and beam waveguide reflectors wherein one beam waveguide reflector is adapted to be shifted transversely to move the feeding point of the sub-reflector. In addition, the tracking antenna is rotatable about an axis along the guide axis.

U.S. Pat. No. 4,062,018 to Yokoi et al. discloses a scanning antenna with a moveable beam waveguide feed similar in structure and operation to the above-described Yokoi et al. patent. Various beam waveguide structures are disclosed. Beam waveguide reflectors are translated in axes along the guide axis.

U.S. Pat. No. 3,845,483 to Soma et al. discloses a beam waveguide feed wherein a rotatable microwave feed portion is interposed between the microwave source and the antenna. The reflector is independently rotatable in two transverse directions along the guide axis.

Two other patents were uncovered as a consequence of a search of the U.S. Patent and Trademark Office records. In the first, U.S. Pat. No. 3,680,141 to Karikomi, there is shown an antenna system with a movable plane reflector and a movable sub-reflector which are used to deflect radiated waves without moving a main reflector. This system is distinguishable in that the main reflector does not move and the sub-reflector moves with respect to the main reflector. U.S. Pat. No. 3,795,003 to Meeke et al. discloses another example of an antenna system with a rotatable feed for use in scanning in a turnstyle scanner. A reflector is used for scanning and switching among feeds. The main reflector in such an antenna system is not intended to be rotated.

General background material in waveguide rotary and swivel joints is found in Sommers et al. "Beam-Waveguide Feed", *Microwave Journal,* November 1975, page 51.

SUMMARY OF THE INVENTION

According to the invention, a method and apparatus are provided for transmitting a microwave signal as a beam having a wavelength small as compared to the size of reflecting surfaces, wherein a main reflector is stationary with respect to a sub-reflector and the main reflector is motional with respect to the feed. The invention comprises rotating the sub-reflector rotated about a first rotational axis transverse and preferably orthogonal to the guide axis, the first rotational axis being on the vertex of a secondary reflector, thereby directing radiation from a fixed feed to the motional sub-reflector. The primary reflector and sub-reflector are disposed relative to one another to share a common focus or confocal point.

Various embodiments of the invention are contemplated including Cassegrainian and Gregorian configurations. The microwave rotary joint according to the invention works best where the motional reflector moves no more than a few tens of degrees depending on beam width, in order to minimize the effects of astigmatism, since astigmatic effects are a function of beam width.

The invention will be better understood by reference of the following detailed description taken in connection with the accompanying drawings.

DESCRIPTION OF SPECIFIC EMBODIMENTS

Figure 1:
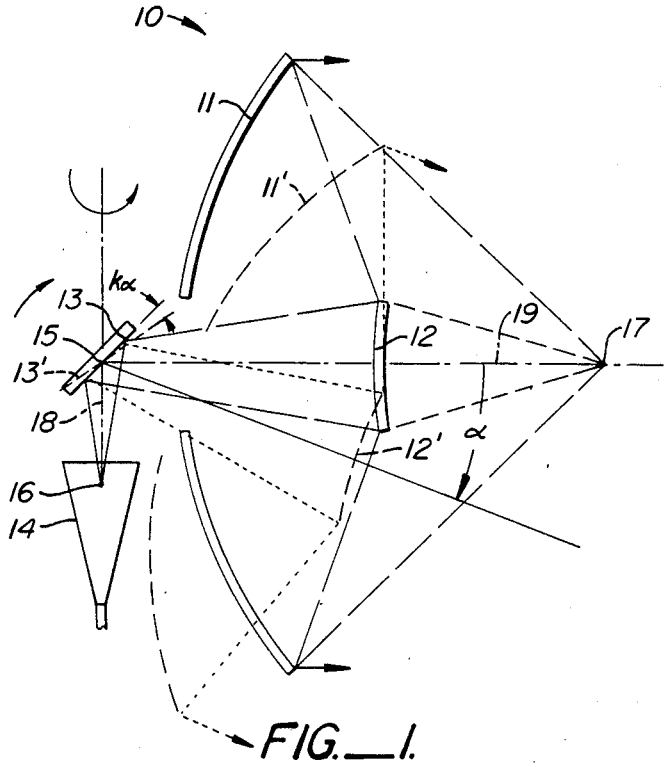
FIG. 1 is a schematic illustration of a rotary joint according to the invention in connection with a stationary feed, a motional secondary reflector, a motional sub-reflector and a motional main reflector arrangement.

Referring to FIG. 1 there is shown an application of a rotary joint arrangement 10 between a motional element such as reflector 11 and a stationary element such as feed 14. The transition between the motional element and the stationary element through which microwave energy is passed may be called a "motional interface". The motional reflector 11, hereinafter referred to as a main reflector, is associated with a sub-reflector 12 which is fixed relative to said main reflector 11 and which together rotate as a unit about a rotational axis at a juncture or vertex 15 on the surface of a secondary reflector 13. As used herein "juncture" refers to an interval, region or point of transition such as an intersection of a ray with a reflection surface or a focal point. The radiation pattern is directed by jointly rotating the main reflector 11 and the sub-reflector 12 at the same rate of rotation. In accordance with the invention, the secondary reflector 13 is also rotated about the vertex 15 at a fixed fractional rotation rate of the rotation rate of the main reflector 11 and sub-reflector 12. After rotation, the main reflector 11 is for example at the position of reflector 11', the sub-reflector 12 is at the position of reflector 12' and secondary reflector 13 is at the position of reflector 13'. Whereas the main reflector has tilted at an angle $\alpha$, the secondary reflector 13' has tilted at an angle $k\alpha$, wherein k is a beam deviation factor less than one. Preferably, the beam deviation factor is equal to approximately one-half. The exact beam deviation factor is determined by geometry. For every position of the main reflector 11, the feed point or juncture is at point or juncture 16 in the stationary feed 14. In accordance with the invention, the rotation is about an axis through the vertex 15 which is perpendicular to the segment 18 guide axis between feed point 16 and vertex 15 and segment 19 of the guide axis between vertex 15 and the confocal point or juncture 17 of reflectors 11 and 12. Rotation of the reflectors 11 and 12 about the segment 18 of the guide axis through vertex 15 is permitted with feed 14 being stationary. Thereby, there is provided full two-axis rotation using a single secondary reflector 13.

Figure 2:
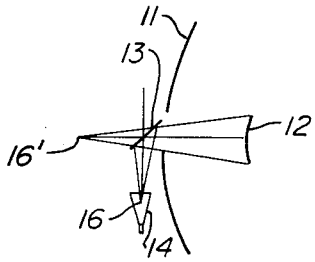
FIG. 2 is a schematic diagram according to the invention showing a Cassegrainian feed system with a plane secondary reflector.

The secondary reflector is shaped appropriately for the application. FIG. 2 illustrates the typical positioning of the primary reflector 11, the sub-reflector 12, and the secondary reflector 13 relative to a stationary feed 14. The secondary reflector 13 is in this example a flat mirror thereby to project a focus to a point 16 in the stationary feed 14. Position 16 is the reflected location of position 16', the virtual focus of the sub-reflector 12. It should be understood that the main reflector 11 and sub-reflector 12 are positioned relative to one another to share a common focus. In other words, the primary reflector 11 and the sub-reflector 12 are confocul.

Figure 3:
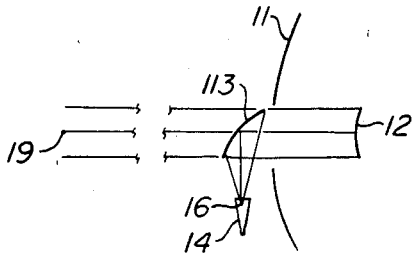
FIG. 3 is a schematic illustration of a Cassegrainian feed system with a focus at infinity according to the invention.

The focus may be selected to be at a focal point along axis 19 at infinity (FIG. 3). In such an instance, the secondary reflector 113 may be concave to produce a focus at a feed point 16 and the stationary feed 14.

Figure 4:
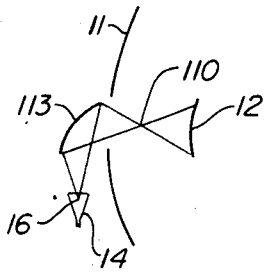
FIG. 4 is a schematic illustration of a Cassegrainian feed system with a focus between the primary reflector and the sub-reflector in accordance with the invention.

In FIG. 4, it is shown that the focus 110 for the confocal mirrors 11 and 12 may be chosen to be between the secondary reflector 113 and the sub-reflector 12 to couple with feed point 16 in the stationary feed 14. The shapes of the reflectors are selected in accordance with the laws of ray optics to accommodate the respective signals. For example, in a configuration in accordance with FIG. 4, the main reflector 11 is a paraboloid, the sub-reflector 12 is a convex hyperboloid and the secondary reflector 113 is a concave ellipsoid. In configuration with FIG. 3, where the focus is at infinity, the main reflector 11 is a paraboloid, sub-reflector is a paraboloid, and the secondary reflector is a paraboloid. Where the focus is at less than infinity, the main reflector is a paraboloid, and the sub-reflector and secondary reflector are each hyperboloids. In the configuration of FIGS. 1 and 2, the secondary reflector 13 is a plane, the main reflector 11 is a paraboloid, and the sub-reflector 12 is a hyperboloid.

Figure 5:
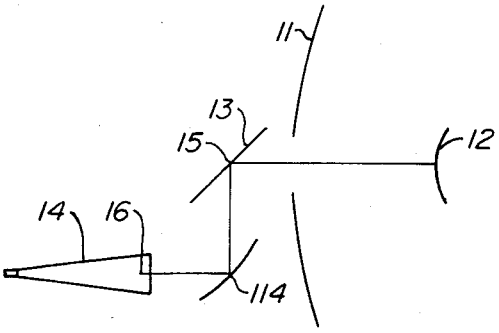
FIG. 5 is a schematic illustration of a Cassegrainian feed system with a first secondary reflector and a second secondary reflector in accordance with the invention.

Referring to FIG. 5, there is illustrated a scheme wherein multiple reflectors are used to transmit signals across the motional interface. The main reflector 11 and sub-reflector 12 are fixed relative to one another. However, a first secondary reflector 13 and second secondary reflector 114 are provided in the optical path between the stationary feed 14 and the sub-reflector 12. Each of the secondary reflectors 13 and 114 are either both or individually movable to effect transfer across the motional interface. For example, the second secondary reflector 114 may be a beam collimating reflector which is fixed and the first secondary reflector 13 may be a plane reflector to direct the signal between its vertex 15 and the sub-reflector 12. The feed point 16 is at the phase center of the stationary feed 14.

Figure 8:
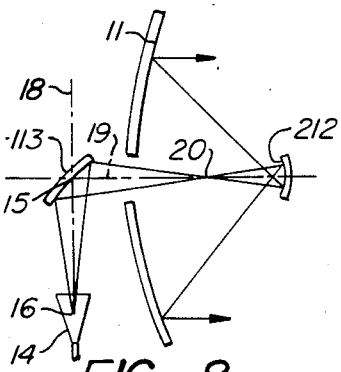
FIG. 8 is a schematic illustration of an apparatus with a Gregorian feed according to the invention.

Reflection systems other than Cassegrainian (or convex sub-reflector) feed systems may be employed as for example as shown in FIG. 8. In FIG. 8, the main reflector 11 shares a confocal point with a concave sub-reflector 212 in a Gregorian feed arrangement. The focal point 20 is between the sub-reflector 212 and the secondary reflector 113 along the segment 19 of the guide axis. The secondary reflector 113 rotates about the vertex 15 perpendicular to the segment 19 and the segment 18 of the guide axis. Secondary reflector 113 is shaped to be fed at the feed point 16 of stationary feed 14.

Figure 6:
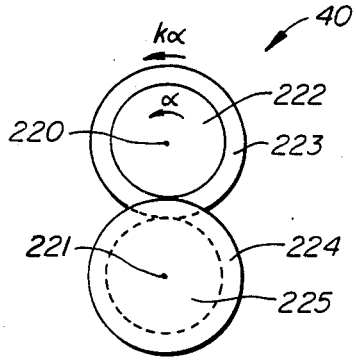
FIG. 6 is a schematic illustration of a fixed ration mechanical linkage gearing arrangement for moving the secondary reflector relative to a motional feed or a motional reflector about a common axis.

Various simple mechanisms are available to achieve proper relative motion of the secondary reflector and the motional feed or reflector arrangement. In one embodiment, independent servo-mechanisms may be employed to move the two structures in fixed proportional relationship. In another embodiment, as illustrated in FIG. 6, a mechanical linkage 40 may be employed which rotates about a common neutral axis 220. A gear 222 may be attached to the motional structure while a gear 223 may be attached to the secondary reflector. A dual idler gear 224, 225 rotates about a fixed axis 221 while gear 224 engages gear 222 and while gear 225 engages gear 223. The correct beam deviation factor K is obtained by proper selection of the ratios of the gear diameters.

Figure 7:
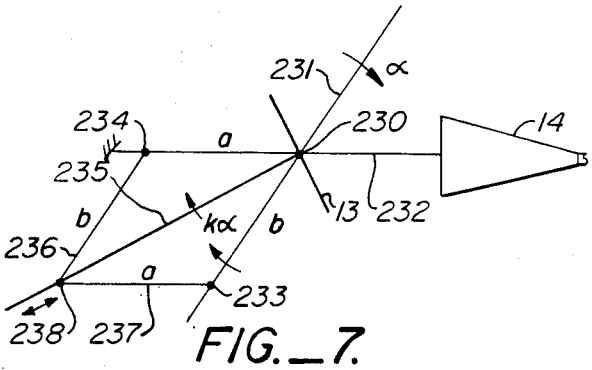
FIG. 7 illustrates a parallelogram linkage between feeds or reflectors according to the invention.

Linkage may also be accomplished by means of bars joined in a parallelogram as illustrated in FIG. 7. Bars 231, 232 and 235 are associated with the motional reflectors, the fixed feed 14 and the secondary mirror 13 respectively. Bars 231, 232 and 235 may be imaginary in that they represent structures establishing the fixed relations about axis 230 for each of the elements of the invention. Bars 231 and 235 pivot about the axis 230. A bar 236 is attached to a fixed bar 232 at a fixed point 234 by means of a bearing or the like. A bar 237 is joined in a similar manner to bar 231 at a point 233. The pivot point 238 common to bars 236 and 237 is free to move along bar 235 by means of sliding connection to bar 235. The rotation of the secondary reflector 13 relative to the main reflector is established by the distance a and b between pivot points 233 and 234 and axis 230. If a equals b the rotation rate of secondary reflector 13 would be exactly one-half of the rotation rate of the main reflector.

Figure 9:
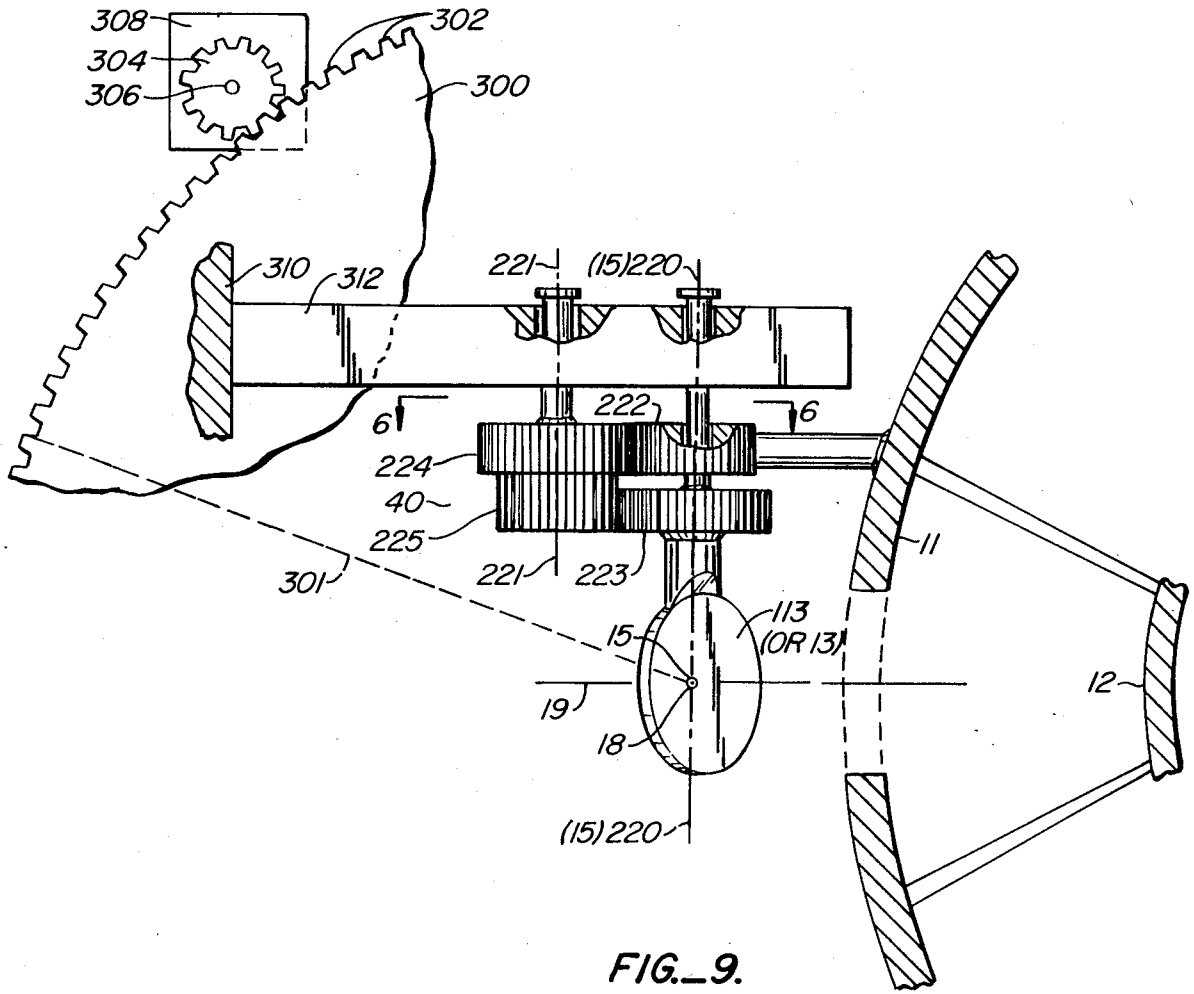
FIG. 9 is a plan view in partial cutaway at a right angle perspective with FIG. 6.
Figure 10:
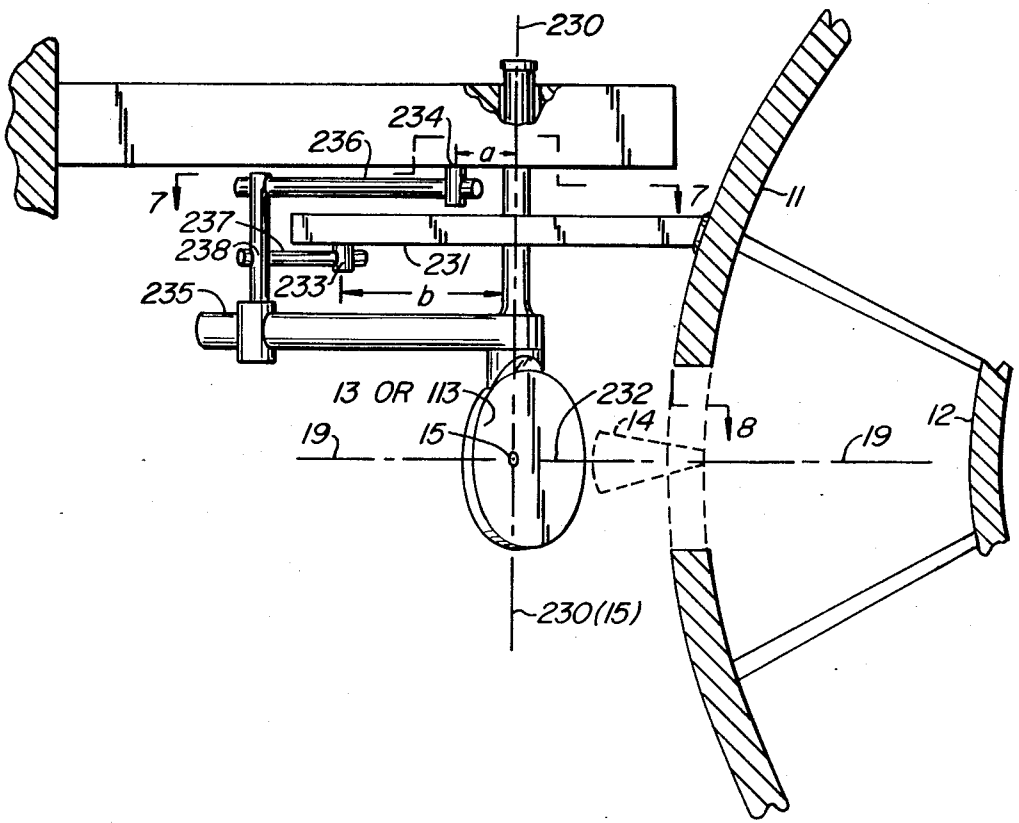
FIG. 10 is a plan view in partial cutaway of a rotary joint according to the invention from a perspective orthogonal to FIG. 7.

FIGS. 9 and 10 show structures illustrating relative movement of the system according to the invention, and specifically relative to reflector 13 (or 113) with respect to a fixed axis in the plane of FIG. 1.

FIG. 9 is a view of FIG. 1 as viewed within the plane of FIG. 1. A platform is shown which has an orientation which is fixed to the axis 18 of FIG. 1 (out of the page), whereas axis 18 is the center of the ray directed to feed 14. In FIG. 9, axis 15 is in the plane of the page and is shown as corresponding exactly to axis 220 of FIG. 6. Gear 223 is fixed to reflector 13 or 113, gear 222 is fixed to reflector 11 and 12, and an idler gear (the combination of gears 224, 225) couples gears 222 and 223. Reflector 13 (or 113) is shown in perspective to convey its role as a reflector in the dimension of the plane containing axes 19 and 18 (axis 18 being perpendicular to the plane of the figure).

FIG. 10 is a side cross-sectional view with a partial perspective (similar to FIG. 9) of the arrangement of FIG. 7 in the environment of FIG. 1. In FIG. 10, the elements of FIG. 7 are shown with reference to a plane perpendicular to axis 231 and are outlined in phantom. In this arrangement feed 14 is out of the page on axis with the plane containing axis 15 and 19. Feed 14 is, therefore, shown offset out of the feed plane of the page, thus allowing viewing of reflector 13 (or 113). Only elements along axis 231 are in the plane of the adjacent portion of FIG. 10. Axis 230 is shown as corresponding exactly to axis 15 with attached thereto a linkage 235. Linkage 235 rotates with respect to the base attached at axis 230. Linkage 235 is fixed to the reflector 13 (or 113). Linkage 236 rotates on pivot 234 and pivot 238. Linkage 237 rotates about pivot 233 and pivot 238, neither of which is fixed relative to a stationary reference, but pivot 233 is fixed to linkage 231. Pivot 238 also slides along linkage 235. The distance between pivot 234 and axis 230 is the same as the distance between pivot 233 and pivot 238. Similarly, the distance between pivot 234 and pivot 238 is the same as the distance between pivot 233 and axis 230.

The linkages of FIG. 7 can be arranged differently from those shown in FIG. 10 so long as the pivot positions shown in the plane of FIG. 7 are preserved. The reflectors 11 and 12 are affixed to linkages 231 whereas reflector 13 (or 113) is affixed to the shaft on axis 230.

Referring again to FIG. 9, a platform 300 (broken-away) with a radius 301 is provided with gear teeth 302 which is driven by a gear 304. Gear 304 is driven by a shaft 306 coupled to a motor 308. This gearing arrangement allows both main reflector 11 and secondary reflector 113 to be rotated about an axis projecting out of the page through the center 15 of platform 300. Platform 300 is coupled to the reflector system with a member 310 coupled to member 312. At the same time, main reflector 11 and secondary reflector 113 can be rotating at their separate, but related, rates about axis 220.

Rotation out of the plane perpendicular to axis 230 may be effected by rotation of the mechanism about an axis along linkage 232.

The invention has now been explained with reference to specific embodiments. Sufficient information has been given to allow a person of ordinary skill in this art to make and use this invention. Other embodiments will be apparent to those of ordinary skill in the art. It is therefore not intended that this invention be limited, except as indicated by the appended claims.

What is claimed is:

1. A method for coupling a microwave signal between a fixed feed of said signal and a motional main reflector, said main reflector having a common focus with a sub-reflector fixedly attached to said main reflector, said method comprising:

directing a beam of said microwave signal by said fixed feed between said fixed feed and a secondary reflector along a guide axis common to said fixed feed and said secondary reflector;

directing said beam by said secondary reflector between said secondary reflector and said sub-reflector;

directing said beam by said sub-reflector between said sub-reflector and said main reflector rotating by a first rotating means said secondary reflector about a first rotational axis at a first rate of rotation, said first rotational axis being through the vertex of said secondary reflector and transverse of said guide axis; and rotating by said first rotating means said sub-reflector and said main reflector together about said first rotational axis at a second rate of rotation, said second rate of rotation being fixed in proportion to said first rate of rotation.

2. The method of claim 1 wherein said first rotational axis is orthogonal to said guide axis at said vertex.

3. The method according to claim 2 wherein said second rate of rotation is approximately equal to twice said first rate of rotation.

4. The method according to claim 1 further including the step of rotating at a third rate of rotation said secondary reflector about said guide axis between said fixed feed and said vertex while rotating said motional main reflector about said guide axis at said third rate of rotation to provide two axis rotation.

5. The method according to claim 1 wherein said secondary reflector is flat and said fixed feed is at a reflected focus of said sub-reflector.

6. The method according to claim 1 wherein said secondary reflector is concave and said fixed feed is at a reflected focus of said sub-reflector.

7. An apparatus for coupling a microwave signal between a fixed feed and a motional main reflector, said apparatus comprising:

means for directing a beam of said microwave signal between said feed adn a secondary reflector along a guide axis, said secondary reflector being operative to direct said beam between said secondary reflector and a sub-reflector said sub-reflector being operative to direct said beam between said sub-reflector and said main reflector, said sub-reflector being disposed confocal with said main reflector;

means for rotating said secondary reflector about a first rotational axis at a first rate of rotation, said first rotational axis being through the vertex of said secondary reflector and transverse of said guide axis; and means for rotating said sub-reflector and said main reflector about said first rotational axis at a second rate of rotation, said second rate of rotation being fixed in proportion to said first rate of rotation.

8. The apparatus of claim 7 wherein said first rotational axis is orthogonal to said guide axis at said vertex.

9. The apparatus according to claim 8 wherein said second rate of rotation is approximately equal to twice said first rate of rotation.

10. The apparatus according to claim 7 wherein said secondary reflector is flat and said fixed feed is at a reflected focus of said sub-reflector.

11. The apparatus according to claim 7 wherein said secondary reflector is concave and said fixed feed is at a reflected focus of said sub-reflector.

12. The apparatus according to claim 7 further including means for rotating said secondary reflector about said guide axis at a third rate of rotation while rotating said main reflector about said guide axis at said third rate of rotation to provide two axis rotation.

* * * * *